US006482014B1

(12) United States Patent
Sawayanagi

(10) Patent No.: US 6,482,014 B1
(45) Date of Patent: Nov. 19, 2002

(54) PRINT BOARD CONNECTOR HAVING RIB FOR HOLDING TERMINALS

(75) Inventor: Masahiro Sawayanagi, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/655,783

(22) Filed: Sep. 6, 2000

(30) Foreign Application Priority Data

Sep. 7, 1999 (JP) ..... 11-253317

(51) Int. Cl.[7] ..... H01R 12/16
(52) U.S. Cl. ..... 439/79
(58) Field of Search ..... 439/79, 78

(56) References Cited

U.S. PATENT DOCUMENTS 5,794,336 A * 8/1998 Hopson et al. ..... 439/79
5,876,222 A * 3/1999 Gardner et al. ..... 439/79

FOREIGN PATENT DOCUMENTS

JP 62-17829 4/1987

* cited by examiner

*Primary Examiner*—Gary R Paumen
(74) *Attorney, Agent, or Firm*—Finnegan, Henderson, Farabow, Garrett & Dunner, L.L.P.

(57) ABSTRACT

A print board connector comprises a print board (20) and a female-type connector housing (11) attached to the rear face of the print board. The print board (20) has an opening (21) and a line of through-holes (22) beside the opening (21). The female-type connector housing (11) includes a hood (11*a*) that has an opening (11*b*) corresponding to the opening (21) of the print board (20) to receive a male connector. Multiple terminals (12) extend out of the hood (11*a*), and the tip of each terminal (12) is inserted in the through-hole (22) of the print board (20). A rib (15) extends on an outer wall of the hood (11*a*) near the opening (11*b*). The rib (15) has through-holes (15*a*) for receiving and holding the terminals (12) below the print board (20).

16 Claims, 3 Drawing Sheets

PRINT BOARD CONNECTOR HAVING RIB FOR HOLDING TERMINALS

The present patent application claims the benefit of earlier Japanese Patent Application No. H11-253317 filed Sep. 7, 1999, the disclosure of which is entirely incorporated herein by reference.

BACKGROUND OF THE INVENTION

1. Field of the Invention

This invention relates to an improved print board connector that comprises a female-type connector housing attached to the rear face of a print board, into which a male connector is to be inserted from the top face of the print board in a reliable manner.

2. Description of the Related Art

Print board connectors of a type, in which a female connector and a print board are assembled into one unit, are known. In general, the female connector is attached to the rear face of the print board, and a male connector is inserted into the female connector from an opening formed in the print board. An example of such connectors is disclosed in, for example, Japanese Patent Application Laid-opened No. 62-17829. In this print board connector, terminal legs are taken out of a female-type connector housing. The end portions of the terminal legs are inserted into a line of through-holes formed in the print board, and soldered to the print board. Soldering the terminals to the print board allows electrical connection between the terminals and the print board, and at the same time, mechanical connection between the connector housing and the print board is guaranteed.

FIG. 1 illustrates an example of such prior art connectors. As shown in FIGS. 1A and 1B, multiple U-shaped terminals 2 are assembled into a female connector housing 1. Each terminal 2 has a terminal leg 2*a* extending out of the female connector housing 1. The end portions of the terminal legs 2*a* are inserted into through-holes 5 formed in a print board 4, and soldered to the print board 4 for the purposes of both electrical connection and mechanical connection between the connector body 6 and the print board 4.

The prior art connector has some problems. First, the connector housing 1 generally has a hood la made of a synthetic resin. The terminals 2 are assembled into the connector housing 1 so that one end of each terminal is accommodated in the hood, and the other end (i.e., the terminal leg 2*a*) is taken out of the hood, which extends toward an opening of the hood. Since the terminal legs 2*a* are soldered to the print board 4, the hood 1*a* is affected by heat during the soldering process, and is eventually deformed, as shown in FIG. 1C. The deformation prevents the male connector from being smoothly inserted into the connector housing 1.

Another problem is that the terminal legs 2*a* extending out of the connector housing 1 are easy to bend or offset from the proper positions. The positional displacement of the terminal legs 2*a* prevents the terminals from being smoothly inserted into the through-holes 5 of the print board 4. This drawback deteriorates the assembling efficiency, and consequently, the product yield is lowered.

SUMMARY OF THE INVENTION

The present invention was conceived to overcome these problems in the prior art. It is an object of the invention to provide a print board connector which is capable of avoiding undesirable deformation of the connector housing, and which allows the terminal legs to be inserted into the through-holes of the print board in a reliable manner.

In order to achieve the object, a print board connector of the present invention comprises a print board, a female-type connector housing attached to the rear face of the print board, and multiple terminals extending out of the connector housing toward the print board. The print board has an opening and a line of through-holes along the opening. The female-type connector housing includes a hood, which has an opening corresponding to the opening of the print board to receive a male connector, and a plurality of terminals extending out of the hood.

As a feature of the invention, a rib extends on an outer wall of the hood near the opening thereof, in order to hold the terminals that extend out of the connector housing. Because the rib holds the terminals outside the hood and near the opening, the end portions of the terminals are reliably guided into the associated through-holes of the print board.

The terminals are soldered to the print board at the through-holes to allow electrical connection. The rib extending on the outer face of the hood also functions as reinforcement, and effectively prevents deformation of the hood during a soldering process.

Preferably, the hood has a rectangular opening, and two longitudinal walls facing each other. Each terminal is U-shaped, one end being accommodated in the hood, and the other end extending out of the hood. The other end of each terminal further extends along one of the longitudinal walls of the hood toward the opening. Preferably, the rib is a flat strip projecting from the outer face of a longitudinal wall along the opening of the hood. The rib has a line of through-holes for receiving the terminals. Although the wall of the hood, along which the terminals extend toward the opening, is most likely to be subjected from heat during the soldering process, the flat strip extending along the longitudinal axis of the opening can effectively prevent deformation of the wall.

The terminals may be arranged in two lines. In this case, the ends of the terminals of one of the lines are guided out of the hood along one of the longitudinal walls of the hood, and the ends of the terminals of the other line are guided out of the hood along the opposite longitudinal wall.

A pair of ribs is provided to the two opposite longitudinal walls of the hood for purposes of holding the terminals extending out of the hood. The print board has a line of through-holes on either side of the opening. Either line of terminals supported by the rib is reliably guided into the through-holes of the print board.

In addition, two ribs provided to the opposite longitudinal walls of the hood can further enhance the reinforcement effect, and deformation of the hood is effectively prevented.

In another aspect of the invention, a connector body used in a print board is provided. The connector comprises a hood having an opening and two opposite longitudinal walls, a plurality of terminals extending out of the hood along one of the longitudinal walls, and a rib projecting from the outer face of said one of the opposite longitudinal walls and for holding the terminals.

Preferably, each terminal is U-shaped, one end being accommodated in the hood, and the other end extending out of the hood.

In still another aspect of the invention, a connector body used in a print board comprises a hood having an opening and two opposite longitudinal walls, and a plurality of terminals extending out of the hood along the two opposite longitudinal walls. A rib projects from the outer face of either longitudinal wall and holds the terminals near the opening of the hood.

BRIEF DESCRIPTION OF THE DRAWINGS

Other objects, features, and advantages of the invention will be apparent from the following detailed description in conjunction with the attached drawings, in which:

FIG. 1 illustrates a conventional print board connector, in which

FIG. 2 illustrates a print board connector according to an embodiment of the invention, in which

DETAILED DESCRIPTION OF THE INVENTION

The invention will now be described in detail in conjunction with the attached drawings.

Figure 1A:
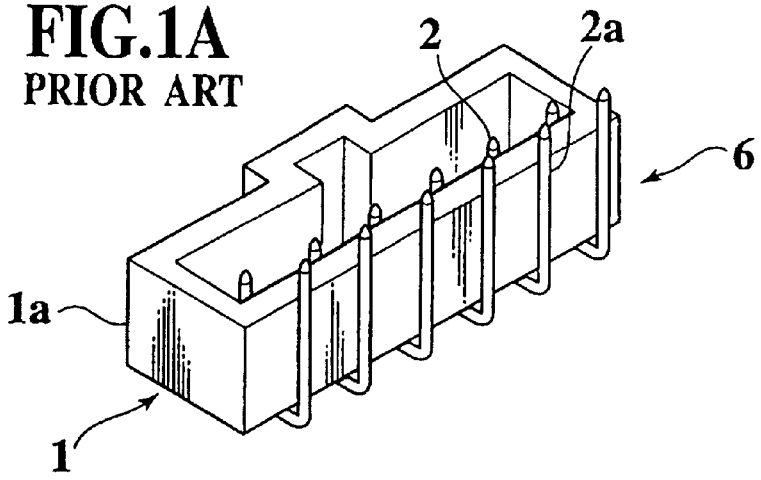
FIG.1A PRIOR ART
FIG. 1A is a perspective view of a connector body.
Figure 1B:
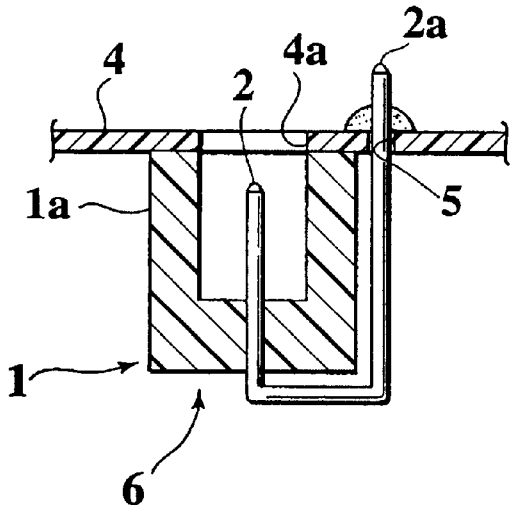
FIG.1B PRIOR ART
FIG. 1B is a cross-sectional view of the connector body fixed to a print board.
Figure 1C:
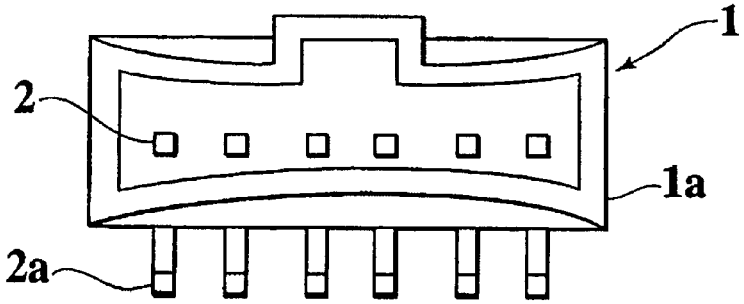
FIG.1C PRIOR ART
FIG. 1C is a top view of the connector body whose side walls are deformed due to heat during a soldering process.
Figure 2A:
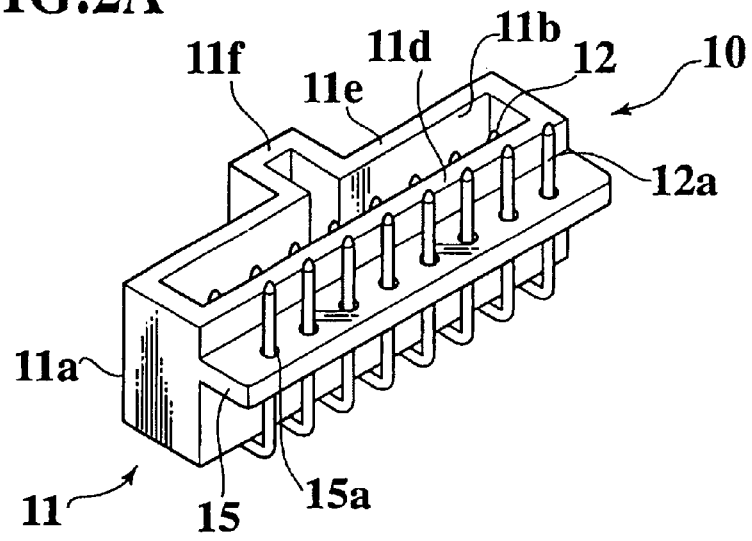
FIG. 2A is a perspective view of a connector body.
Figure 2B:
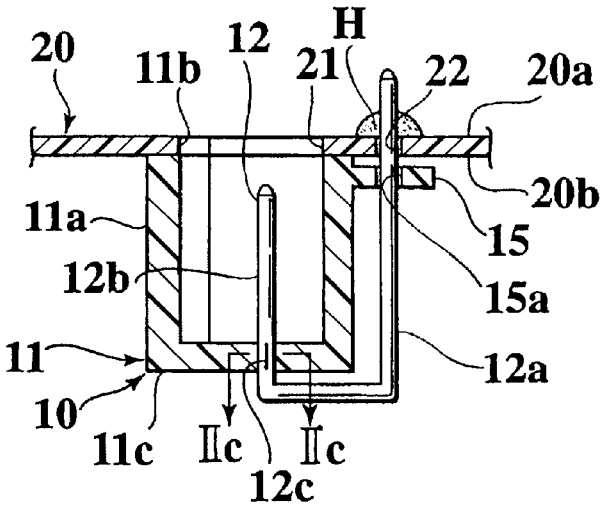
FIG. 2B is a cross-sectional view of the connector body fixed to a print board.

FIG. 2 illustrates a print board connector according to an embodiment of the invention. The print board connector includes a connector body 10, show in FIG. 2A, and a print board 20, shown in FIG. 2B. The print board 20 has an opening 21 and a line of through-holes 22 along the opening 21. The connector body 10 comprises a connector housing 11 made of a synthetic resin, and a plurality of terminals 12. The connector housing 11 has an opening 11*b*, which corresponds to the opening 21 of the print board 20, and a rib 15 extending along the longitudinal axis of the connector housing 11.

The connector body 10 is attached to the rear face of the print board 20. One end of each terminal 12 is taken out of the connector housing 11, and extends along a wall of the connector housing 11 so as to be perpendicular to the opening 11*b*. The end portions of the terminals 12 extending outside the connector housing 11 are called terminal legs 12*a*.

The terminal legs 12*a* are guided into the through-holes 22 of the print board 20, and soldered to the print board, as indicated by symbol H in FIG. 2B.

To be more precise, the connector body 10 comprises a female-type connector housing 11 with a hood 11*a*, and terminals 12 assembled into the hood 11*a*. The connector housing 11 has two opposed longitudinal walls 11*d* and 11*e*, and accordingly, the hoods 11*a* has a rectangular opening 11*b* for receiving a male connector, which is to be fit into the connector housing 11 from the opening 21 of the print board 20.

Each terminal 12 is U-shaped, one end 12*b* being accommodated in the hood 11*a*, the other end (i.e. , the leg 12*a*) being taken out of the hood 11*a*. For the sake of explanation, one end 12*b* is referred to as a first end 12*b*, and the terminal leg 12*a* is referred to as a second end 12*a* depending on the contexts. Preferably, the first ends 12*b* of the terminals 12 are arranged in a line in the hood 11*a* along the longitudinal axis of the connector housing 11, as shown in FIGS. 2A and 2B.

The terminal legs 12*a* extend toward the opening 11*b* of the connector housing 11. In this embodiment, the length of the leg (i. e. , the second end) 12*a* is longer than the opposite end (i.e., the first end) 12*b* placed inside the hood 11*a*.

Each terminal 12 also has a pressurized part 12*c* near the base of the first end 12*b*. The pressurized part 12*c* is forcibly pushed into a hole (not shown) of the bottom wall 11*c* of the connector housing 11, and comes into tight contact with the bottom wall 11*c*.

Figure 2C:
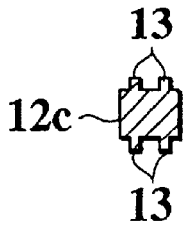
FIG. 2C is an enlarged cross-sectional view taken along the IIc—IIc line show in FIG. 2B.

FIG. 2C is a cross-sectional view of the pressurized part 12*c* of the terminal 12. The pressurized part 12*c* has stopper projections 13, which enhance the engagement between the pressurized part 12*c* and the bottom wall 11*c* of the housing 11.

The terminals 12 are assembled into the connector housing 11 by inserting the first end (or the shorter end) 12*b* of each terminal 12 into the hole of the bottom wall 11*c* until the pressurized part 12*c* comes into tight contact with the bottom wall 11*c*. In this state, the second ends (i.e., the legs) 12*b* of the terminals 12 extend parallel to one another and along the longitudinal wall lid of the connector housing 11.

As a feature of the invention, the connector housing 11 has a rib 15 on the longitudinal wall 11*d*. The rib 15 extends along the longitudinal axis of the opening 11*c*. The rib 15 has a line of through-holes 15*a* at a prescribed interval. Each through-hole 15*a* receives an associated terminal leg 12*a* at a certain clearance.

If the connector body 10 is attached to the rear face of the print board 20, the terminal legs 12*a* are easily guided into the through-holes 22 of the print board 20 without fail because each terminal leg 12*a* is held by the rib 15 at a proper position. This arrangement can greatly improve the assembling efficiency. In addition, the rib 15 effectively protects the terminal legs 12*a* from bending or offset from the proper position before the connector body 10 is attached to the print board 20.

The rib 15 also functions as reinforcement of the longitudinal wall lid of the hood 11*a*. In other words, the rib can prevent the hood 11*a* from thermal deformation during a soldering process. Since the shape of the hood 11*a* is kept correct, a male connector is smoothly inserted in the female-type connector housing 11.

The connector housing 11 has a lock-receiving slot 11*f* as a part of the longitudinal wall lie, into which a lock of a male connector (not shown) is to be fitted. The lock-receiving slot 11*f* projects outward opposite to the rib 15, and receives a lock of the male connector when it is inserted into the female-type connector housing 11.

Although, in this embodiment, the terminals 12 are forcibly inserted in the connector housing 11 from the bottom of the hood 11*a*, the terminals 12 may be formed simultaneously with the connector housing 11 by an insert molding.

Figure 3A:
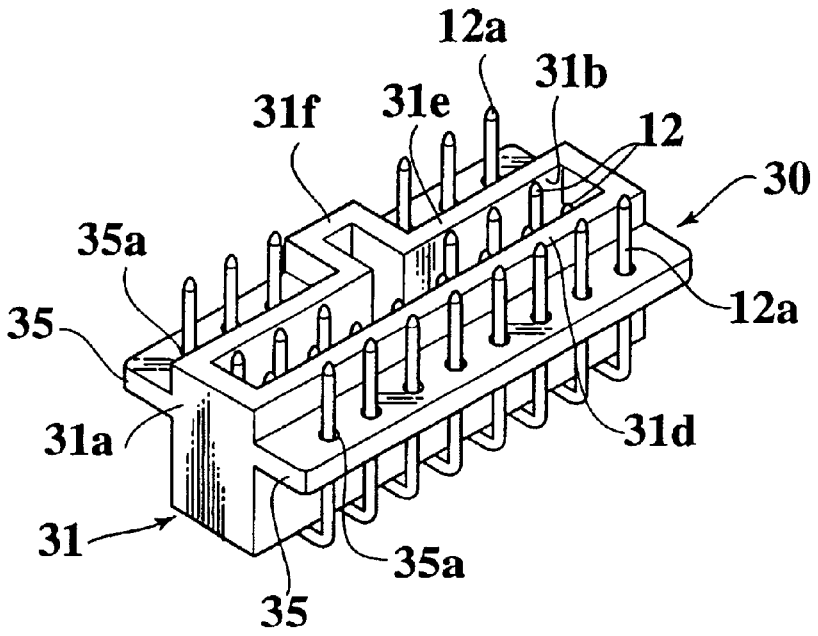
FIG. 3 illustrates a print board connector according to another embodiment of the invention, which has a pair of ribs.
Figure 3B:
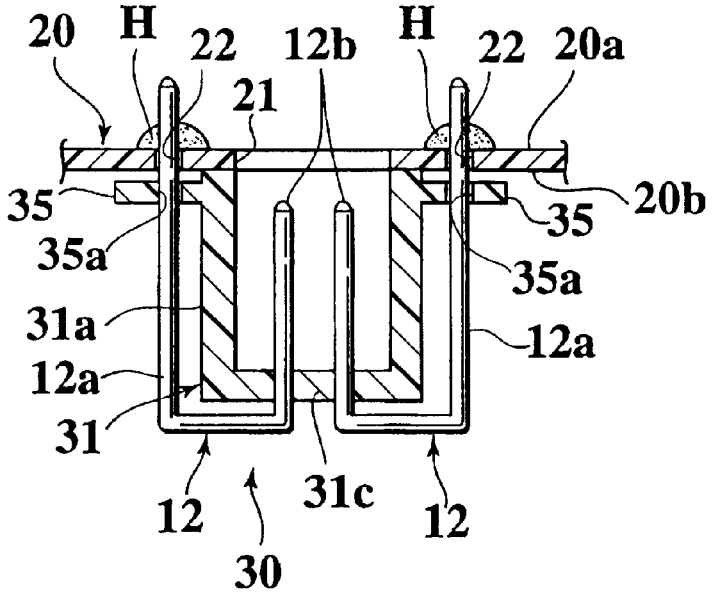

FIG. 3 illustrates a modification of the print board connector according to another embodiment of the invention.

In FIG. 3, terminals 12 are arranged in two lines in the hood 31*a* of the connector housing 31. The connector housing 31 has longitudinal walls 31*d* and 31*e* extending along the longitudinal axis of the opening 31*b* and facing each other. A pair of ribs 35 is provided on the two opposite longitudinal walls 31*d* and 31*e* near the opening 31*b* of the hood 31*a*. Each rib 35 has a line of through-holes 35*a*.

The first ends 12*b* of the terminals are arranged in two lines and accommodated in the hood 31*b*. The second ends 12*a* of the terminals 12 in one of the lines are taken out of the hood 31*a*, and extend along one of the longitudinal walls.

The second ends 12*a* of the terminal 12 in the other line are taken out of the hood 31*a,* and extend along the opposite longitudinal wall. The second ends, that is, the terminal legs 12*a* are received in the through-holes 35*a* of the associated rib 35 at a certain clearance therein.

The connector housing 11 has a lock-receiving slot 31*f* for receiving the lock of a male connector, as in the example shown in FIG. 2. Accordingly, the rib 35 provided on the longitudinal wall 31*e* is interrupted by the lock-receiving slot 31*f* in the middle, but extend on either side of the lock-receiving slot 31*f* in parallel to the opening 31*b* of the hood 31*a*.

The ribs 35 hold the terminal legs 12*a* at proper positions, and reliably guide the legs 12*a* into the through-holes 22 of the print board 20. At the same time, the ribs 35 reinforce the two opposite longitudinal walls 31*d* and 31*e,* and effectively prevent the hood 31*a* from deforming during the soldering process.

As has been explained, one or more ribs are provided to outer faces of the connector housing. Each rib has a line of through-holes for receiving and holding the terminal legs that extend out of the connector housing.

The ribs also function as reinforcement of the connector housing, especially, the longitudinal walls along an opening, which is most likely to be affected by heat during a soldering process for electrically connecting the terminal legs to the print board.

If the terminals are arranged in two lines, a pair of ribs is provided to the two opposite longitudinal walls to hold the terminal legs on both sides of the hood. This arrangement can further reinforce the connector housing, protecting the hood of the connector housing from thermal deformation.

It should be noted that, besides those already mentioned above, many modifications and variations may be made without departing from the novel and advantageous features of the present invention. Such modifications are also included in the scope of the invention defined by the appended claims.

For example, the terminals may be arranged in three or more lines in the hood, the terminals in two adjacent lines being positioned alternately. In this case, a rib may have two or more lines of through-holes for receiving and holding the terminal legs at alternate positions.

Furthermore, two or more ribs may be provided to one of the longitudinal walls of the hood in order to hold the terminals and reinforce the hood in a more reliable manner.

What is claimed is:

1. A print board connector comprising:

a print board having an opening and through-holes arranged near the opening;

a female-type connector housing attached to the rear face of the print board, the connector housing including a hood having an opening corresponding to the opening of the print board to receive a male connector, and an outer wall with a predetermined length;

a plurality of terminals extending out of the hood, the tip of each terminal being inserted into the through-hole of the print board; and at least one rib integrally formed with the outer wall substantially along the entire length and projecting from the outer wall near the opening thereof to reinforce the outer wall against bending, each rib having through-holes for receiving and holding each of the terminals below the print board.

2. The print board connector according to claim 1, wherein the rib is a flat strip extending along the outer face of the hood in parallel to the longitudinal axis of the opening thereof.

3. The print board connector according to claim 1, wherein each terminal is U-shaped, one end being accommodated inside the hood, and the other end being extended out of the hood and through the through-hole of the rib.

4. The print board connector according to claim 1, wherein:

the terminals are arranged in a single row inside the hood, and extended out of the hood along an outer wall of the hood; and the at least one rib is provided on the outer face of the hood on the same side as the terminals.

5. The print board connector according to claim 1, wherein:

the terminals are arranged in two or more rows inside the hood, and extended out of the hood on both sides of the hood; and the at least one rib is provided to both opposed outer faces of the hood to receive and hold the terminals at both sides of the hood.

6. The print board connector according to claim 1, wherein the opening of the hood is rectangular.

7. A connector body used in a print board, comprising:

a connector housing attached to the rear face of the print board and including a hood having an opening and two opposite longitudinal walls extending downward from the opening, each of the longitudinal walls having a predetermined length;

a plurality of terminals extending out of the hood parallel to one of the longitudinal walls; and at least one rib integrally formed with one of the longitudinal walls substantially along the entire length and projecting outwardly from said one of the longitudinal walls for reinforcing the one longitudinal wall against bending and having through holes for receiving and holding each of the terminals.

8. The connector body according to claim 7, wherein each terminal is U-shaped and has two ends, one of the two ends being accommodated inside the hood, and the other of the two ends extending out of the hood and being held by the rib.

9. The connector body according to claim 7, wherein the at least one rib comprises through-holes for receiving and holding the plurality of terminals.

10. The connector body according to claim 7, wherein the at least one rib is a flat strip extending along the outer face of the hood in parallel to the longitudinal axis of the opening thereof.

11. A connector body used in a print board, comprising:

a connector housing attached to the rear face of the print board and including a hood, the hood having an opening and two opposite longitudinal walls extending downward from the opening, each of the longitudinal walls having a predetermined length;

a plurality of terminals extending out of the hood along the two opposed longitudinal walls; and a rib integrally formed with each of the longitudinal walls substantially along the entire length thereof and projecting outwardly there form for reinforcing the respective walls against bending and having through holes for receiving and holding each of the terminals on both sides of the hood.

12. The connector body according to claim 11, wherein:

each of the terminals comprises a first end and a second end, the first end of each terminal being arranged inside the hood and the second end of each terminal being extended out of the hood;

the first ends of the terminals inside the hood are arranged in a first row and a second row; and the second ends of the terminals with first ends arranged in the first row are extended to one side of the hood, and the second ends of the terminals with first ends arranged in the second row are extended to the other side of the hood.

13. The connector body according to claim 11, wherein each terminal is U-shaped.

14. The connector body according to claim 11, wherein each of the ribs comprises through-holes for receiving and holding the plurality of terminals.

15. The connector body according to claim 11, wherein each of the ribs is a flat strip extending along the outer face of the hood in parallel to the longitudinal axis of the opening thereof.

16. The connector body according to claim 12, wherein each of the ribs comprises through-holes for receiving and holding the plurality of terminals.

* * * * *

UNITED STATES PATENT AND TRADEMARK OFFICE

CERTIFICATE OF CORRECTION

PATENT NO. : 6,482,014 B1
DATED : November 19, 2002
INVENTOR(S) : Masahiro Sawayanagi It is certified that error appears in the above-identified patent and that said Letters Patent is hereby corrected as shown below:

Column 6,
Line 66, “there from” should read -- therefrom --.

Signed and Sealed this

Twenty-fifth Day of March, 2003

JAMES E. ROGAN
*Director of the United States Patent and Trademark Office*